US007519405B1

(12) United States Patent
Brent

(10) Patent No.: US 7,519,405 B1
(45) Date of Patent: Apr. 14, 2009

(54) MOTORCYCLE HELMET

(76) Inventor: Rhonda Brent, 7942 S. Mozart, Chicago, IL (US) 60652

( * ) Notice: Subject to any disclaimer, the term of this patent is extended or adjusted under 35 U.S.C. 154(b) by 605 days.

(21) Appl. No.: 11/337,289

(22) Filed: Jan. 23, 2006

Related U.S. Application Data

(63) Continuation-in-part of application No. 10/076,563, filed on Feb. 15, 2002, now abandoned.

(51) Int. Cl.
*H04M 1/00* (2006.01)
*H04B 1/38* (2006.01)

(52) U.S. Cl. ..... 455/575.9; 455/90.1; 455/11.1; 455/569.1; 455/575.2; 340/539.1; 340/539.18

(58) Field of Classification Search ..... 455/90.1, 455/11.1, 569.1, 344, 345, 351, 66.1, 326, 455/404, 575.2, 74; 340/539.1, 539.18, 539.22
See application file for complete search history.

(56) References Cited

U.S. PATENT DOCUMENTS

| | | | |
|---|---|---|---|
| 4,077,007 | A | 2/1978 | McKinney |
| D249,396 | S | 9/1978 | Kamata |
| 4,524,461 | A | 6/1985 | Kostanty et al. |
| 4,663,785 | A | 5/1987 | Comparetteo |
| 5,136,657 | A | 8/1992 | Hattori |
| 5,280,651 | A | 1/1994 | Lenihan et al. |
| 5,465,421 | A | 11/1995 | Mc Cormick et al. |
| 6,115,846 | A | 9/2000 | Truesdale |
| 6,157,298 | A | 12/2000 | Garfinkel et al. |
| 6,725,020 | B2 | 4/2004 | Yagi |
| 6,732,381 | B1 | 5/2004 | Lal |

FOREIGN PATENT DOCUMENTS

| | | |
|---|---|---|
| GB | 2290696 | 10/1996 |

*Primary Examiner*—Tony T Nguyen

(57) ABSTRACT

A motorcycle helmet for permitting a user to listen to a compact disk while wearing a helmet. The motorcycle helmet includes a helmet being designed for protecting a head of a user from impact. The helmet has a perimeter wall defining an interior space. A playing assembly is positioned in the perimeter wall of the helmet. The playing assembly is designed for reading audio information from a compact disc. Each of a plurality of speakers is positioned in the perimeter wall of the helmet. Each of the speakers is operationally coupled to the playing assembly. Each of the speakers is designed for audibly playing the audio information read by the playing assembly.

17 Claims, 8 Drawing Sheets

MOTORCYCLE HELMET

REFERENCE TO RELATED APPLICATION

This application is a continuation-in-part of application Ser. No. 10/076,563, filed Feb. 15, 2002 now abandoned.

BACKGROUND OF THE INVENTION

1. Field of the Invention

The present invention relates to sound devices mounted in a helmet and more particularly pertains to a new motorcycle helmet for permitting a user to listen to a compact disk while wearing a helmet.

2. Description of the Prior Art

The use of sound devices mounted in a helmet is known in the prior art. U.S. Pat. No. 5,136,657 describes a device for being mounted in a helmet for allowing a user to listen to pre-recorded material while wearing the helmet. Another type of sound device mounted in a helmet is U.S. Pat. No. 4,077,007 having a radio and antennae mounted in a helmet for picking up radio broadcasts and playing for the wearer to hear. U.S. Pat. No. 4,524,461 has a radio system for receiving for the user of the helmet to hear and transmitting radio signals for the user. U.S. Pat. No. 5,280,651 having a portable sound system for generating audio signals for a user to hear while wearing headphones. U.S. Pat. No. 5,462,421 has a helmet having a plurality of speakers coupled to a jack for being plugged into a portable audio device to allow a user to listen to music while wearing the helmet.

While these devices fulfill their respective, particular objectives and requirements, the need remains for a device that has certain improved features that allows a user to wear a protective helmet and listen audio compact disks.

SUMMARY OF THE INVENTION

The present invention meets the needs presented above by providing a playing assembly positioned in a helmet that reads audio compact disks and has a plurality of speaker to audibly transmit the music to the user.

Still yet another object of the present invention is to provide a new motorcycle helmet that allows a user to listen to audio compact discs while wearing a protective helmet.

To this end, the present invention generally comprises a helmet being designed for protecting a head of a user from impact. The helmet has a perimeter wall defining an interior space. The perimeter wall has a lower peripheral lip defining a lower opening whereby the lower opening is designed for permitting the head of the user to be inserted into the interior space of the helmet. The perimeter wall has a forward peripheral lip defining a front opening whereby the front opening is designed for permitting the user to see when the head of the user is positioned in the interior space. A playing assembly is positioned in the perimeter wall of the helmet. The playing assembly is designed for reading audio information from a compact disc. Each of a plurality of speakers is positioned in the perimeter wall of the helmet. Each of the speakers is operationally coupled to the playing assembly. Each of the speakers is designed for audibly playing the audio information read by the playing assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
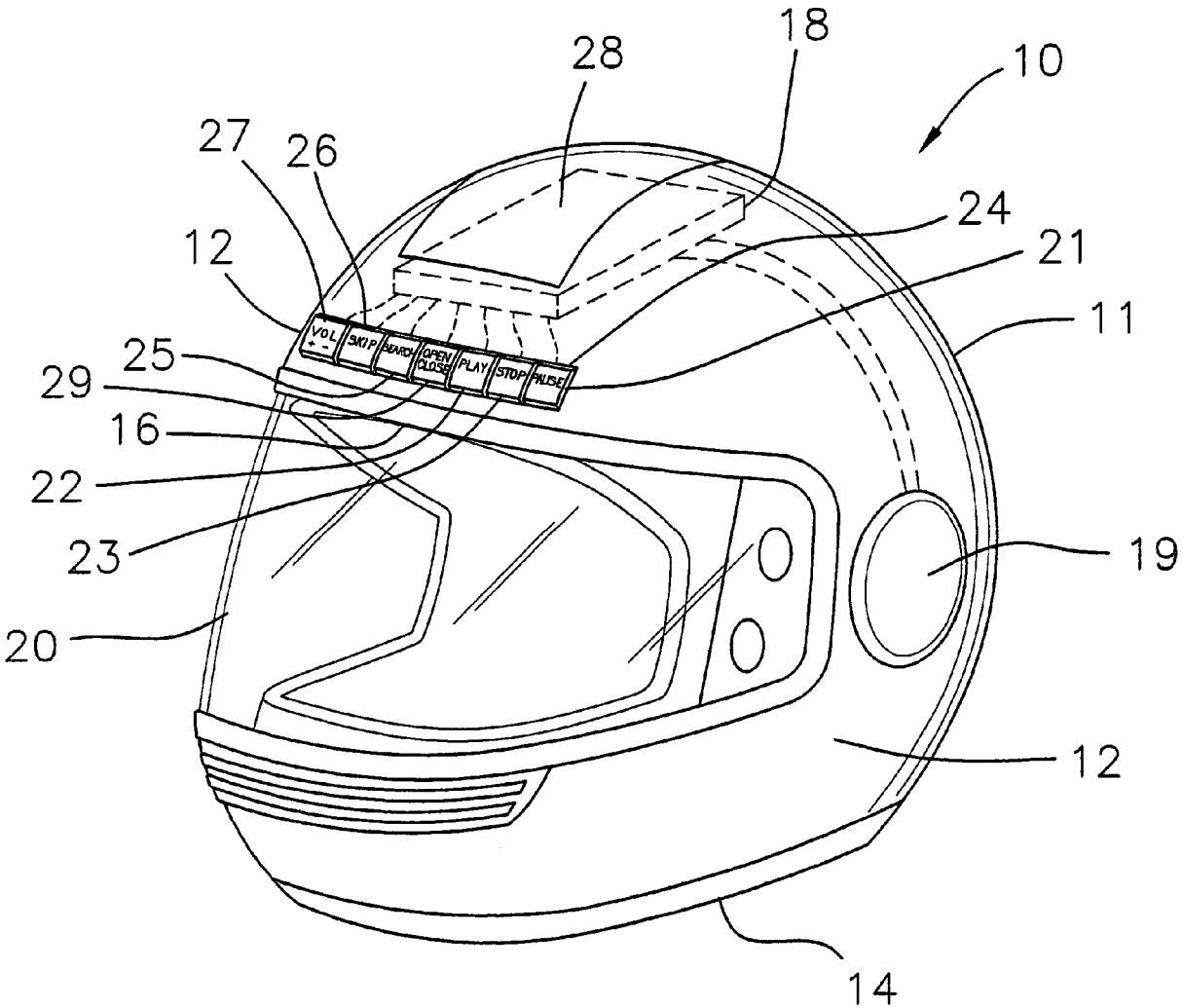
FIG. 1 is a perspective view of a new motorcycle helmet according to the present invention.
Figure 2:
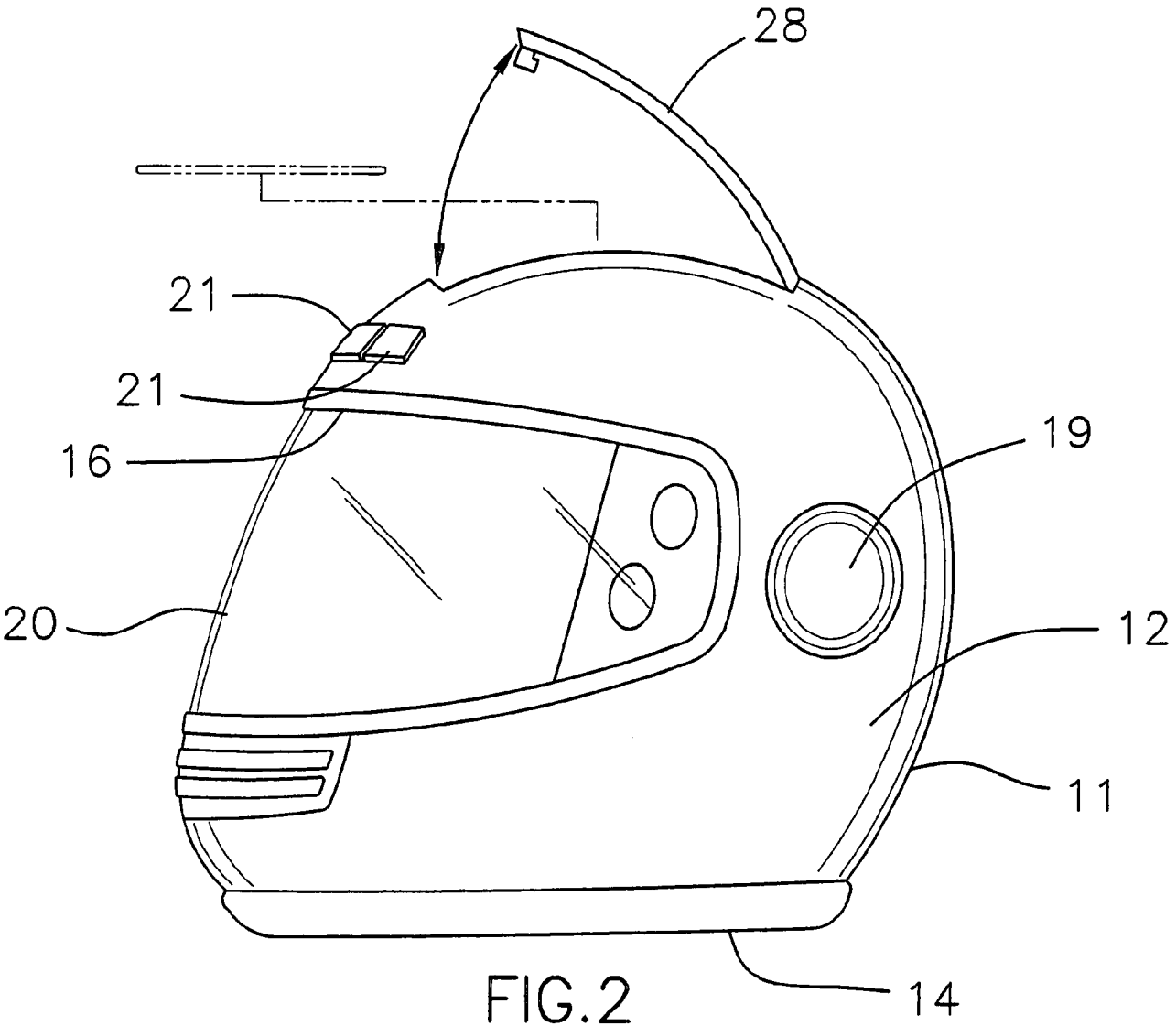
FIG. 2 is a side view of the present invention with the lid member in the open position.
Figure 3:
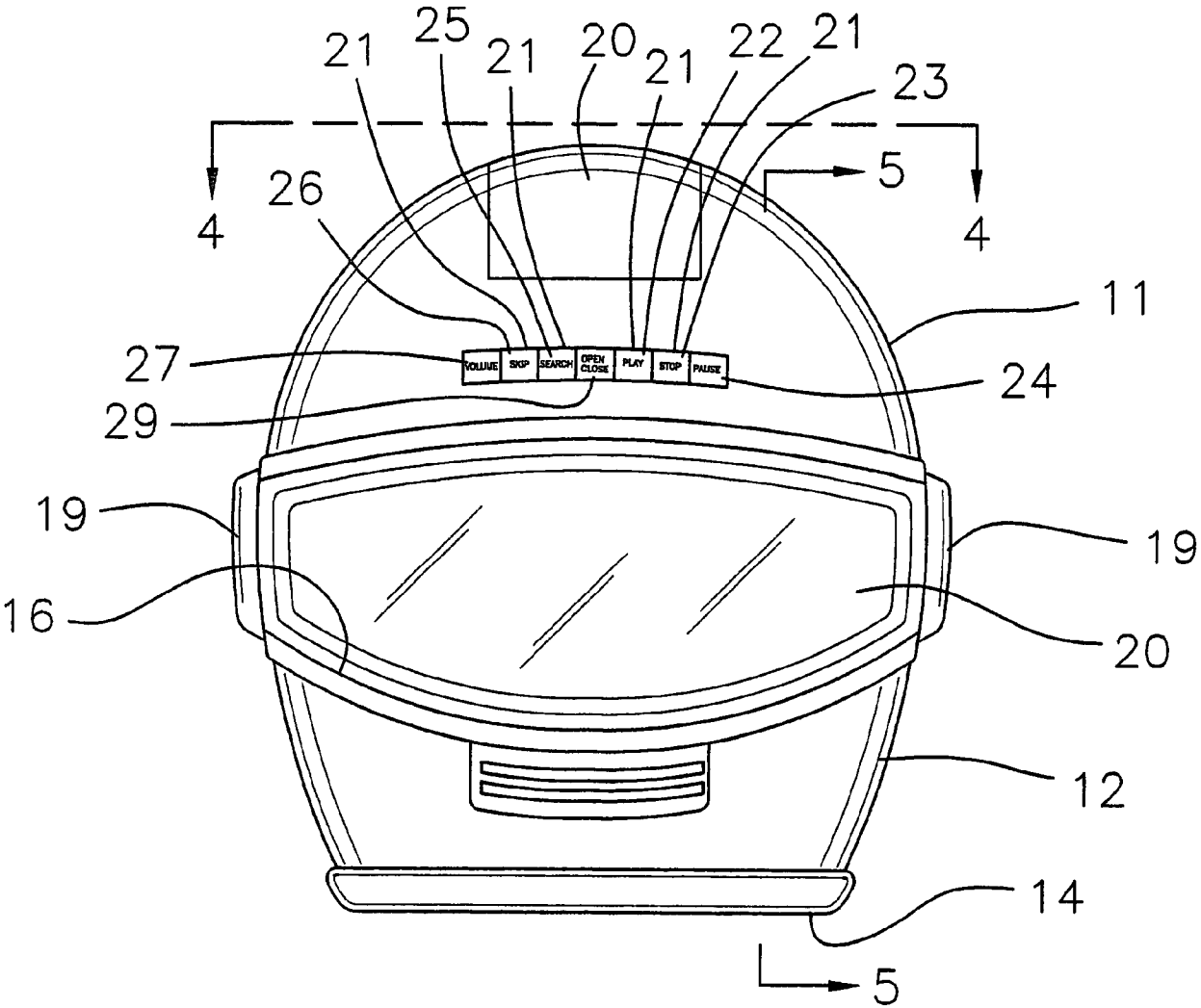
FIG. 3 is a front view of the present invention.
Figure 4:
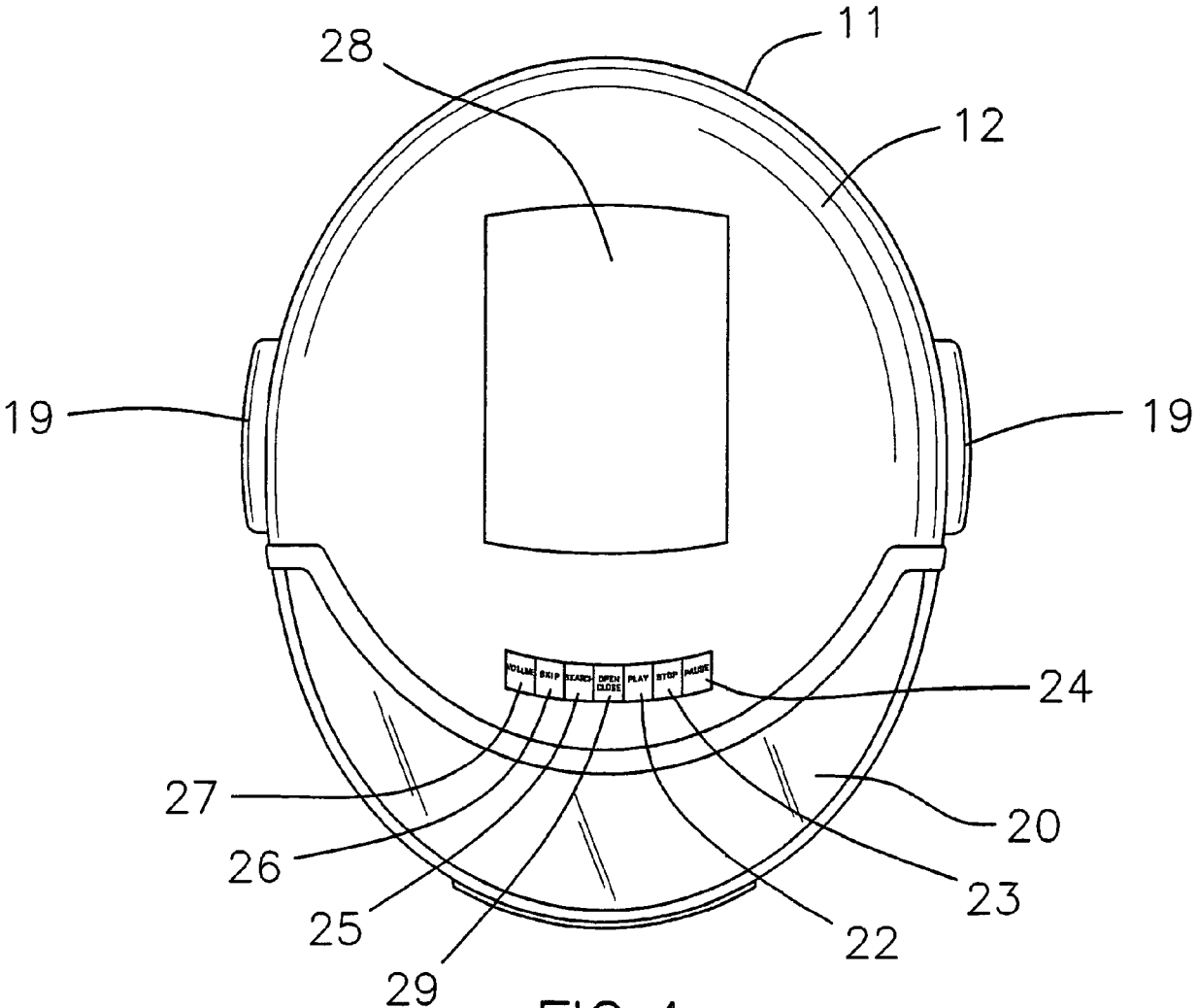
FIG. 4 is a top view of the present invention taken along line 4-4 of FIG. 3.
Figure 5:
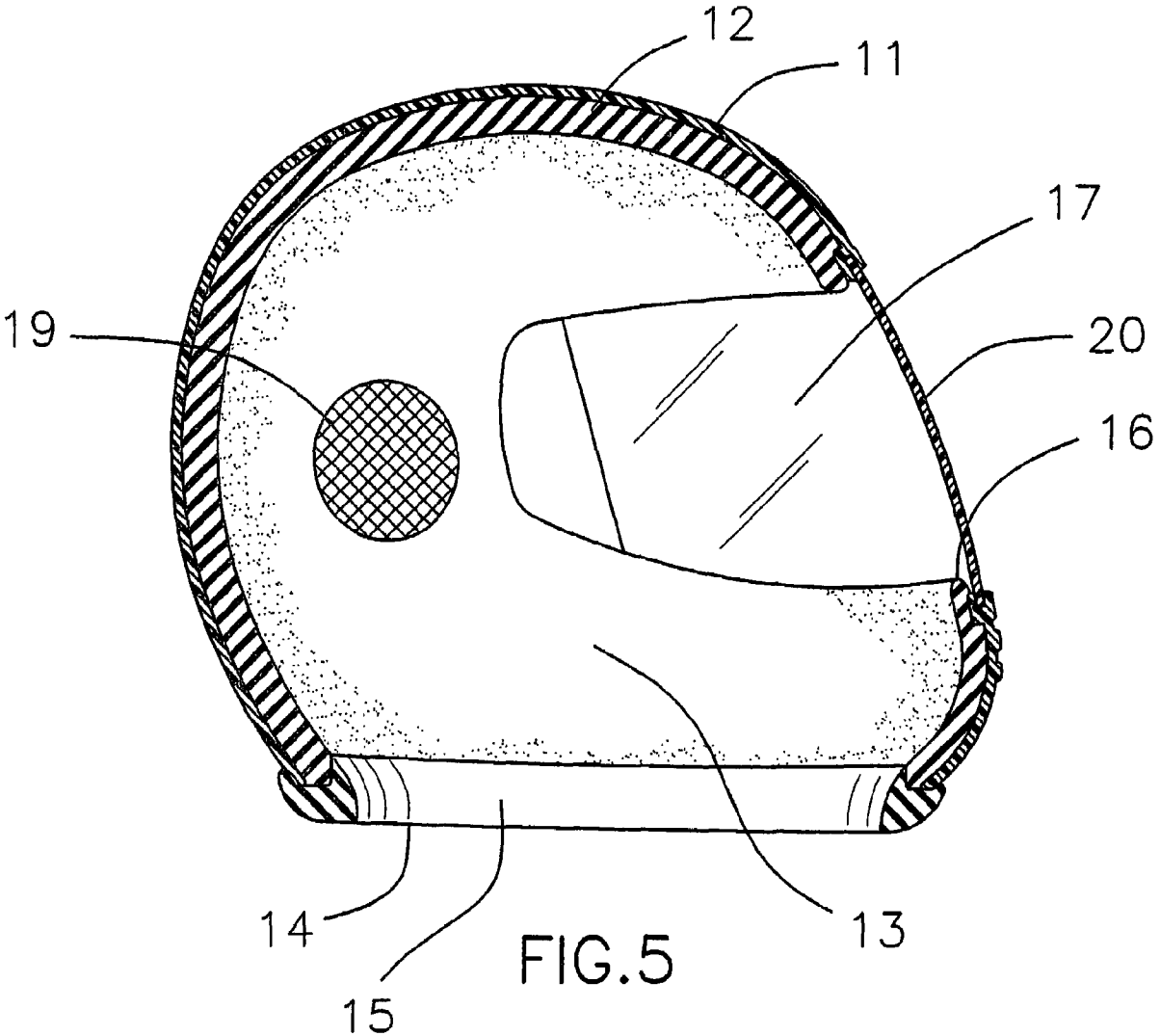
FIG. 5 is a cross-sectional view of the present invention taken along line 5-5 of FIG. 3.

With reference now to the drawings, and in particular to FIGS. 1 through 8 thereof, a new motorcycle helmet embodying the principles and concepts of the present invention and generally designated by the reference numeral 10 will be described.

As best illustrated in FIGS. 1 through 8, the motorcycle helmet system 10 generally comprises a helmet 11 being designed for protecting a head of a user from impact. The helmet 11 has a perimeter wall 12 defining an interior space 13. The perimeter wall 12 has a lower peripheral lip 14 defining a lower opening 15 whereby the lower opening 15 is designed for permitting the head of the user to be inserted into the interior space 13 of the helmet 11. The perimeter wall 12 has a forward peripheral lip 16 defining a front opening 17 whereby the front opening 17 is designed for permitting the user to see when the head of the user is positioned in the interior space 13.

A playing assembly 18 is positioned in the perimeter wall 12 of the helmet 11. The playing assembly 18 is designed for reading audio information from a compact disc.

Each of a plurality of speakers 19 is positioned in the perimeter wall 12 of the helmet 11. Each of the speakers 19 is operationally coupled to the playing assembly 18. Each of the speakers 19 is designed for audibly playing the audio information read by the playing assembly 18.

The helmet 11 has a visor portion 20. The visor portion 20 is positioned in the front opening 17 of the helmet 11. The visor portion 20 is designed for deflecting wind around the helmet 11 and out of the eyes of the user.

A plurality of buttons 21 is operationally coupled to the playing assembly 18. The buttons 21 are positioned in the perimeter wall 12 of the helmet 11 proximate the front opening 17 of the helmet 11 whereby the buttons 21 are designed for being easily accessible by the user. Each of the buttons 21 is for controlling a function of the playing assembly 18 when the buttons 21 are actuated by the user.

The buttons 21 may comprise a play button 22. The play button 22 is for actuating the playing assembly 18 whereby the playing assembly 18 reads audio information from the compact disk received by the playing assembly 18.

The buttons 21 may comprise a stop button 23. The stop button 23 is for actuating the playing assembly 18 whereby the playing assembly 18 discontinues reading of audio information from the compact disc when the user has previously actuated the play button 22.

The buttons 21 may comprise a pause button 24. The pause button 24 is for actuating the playing assembly 18 whereby the playing assembly 18 pauses reading of audio information from the compact disc when the pause button 24 is actuated once by the user. The playing assembly 18 is designed for resuming reading of audio information from the compact disc when the pause button 24 is actuated a second time by the user.

The buttons 21 may comprise a search button 25. The search button 25 is for actuating the playing assembly 18 whereby the playing assembly 18 fast forwards through the audio information from the compact disc when the user has previously actuated the play button 22.

The buttons 21 may comprise a skip button 26. The skip button 26 is for actuating the playing assembly 18 whereby the playing assembly 18 skips to the audio information of the next song on the compact disc when the user has previously actuated the play button 22.

The buttons 21 may comprise a volume button 27. The volume button 27 is for actuating the playing assembly 18 for controlling the volume of the speakers 19.

The helmet 11 has a lid member 28. The lid member 28 is pivotally coupled to the perimeter wall 12 of the helmet 11. The lid member 28 is positioned adjacent the playing assembly 18. The lid member 28 is pivotable between an open position and a closed position. The lid member 28 is designed for permitting the compact disc to be operationally coupled to the playing assembly 18 when the lid member 28 is in the open position. The lid member 28 is designed for covering the compact disc when the lid member 28 is the closed position.

A lid button 29 is operationally coupled to the lid member 28. The lid button 29 is positioned in the perimeter wall 12 of the helmet 11 proximate the front opening 17 of the helmet 11 whereby the lid button 29 is designed for being easily accessible by the user. The lid button 29 is for permitting the lid member 28 to be pivoted between the open position and the closed position when the lid button 29 is actuated by the user.

Figure 6:
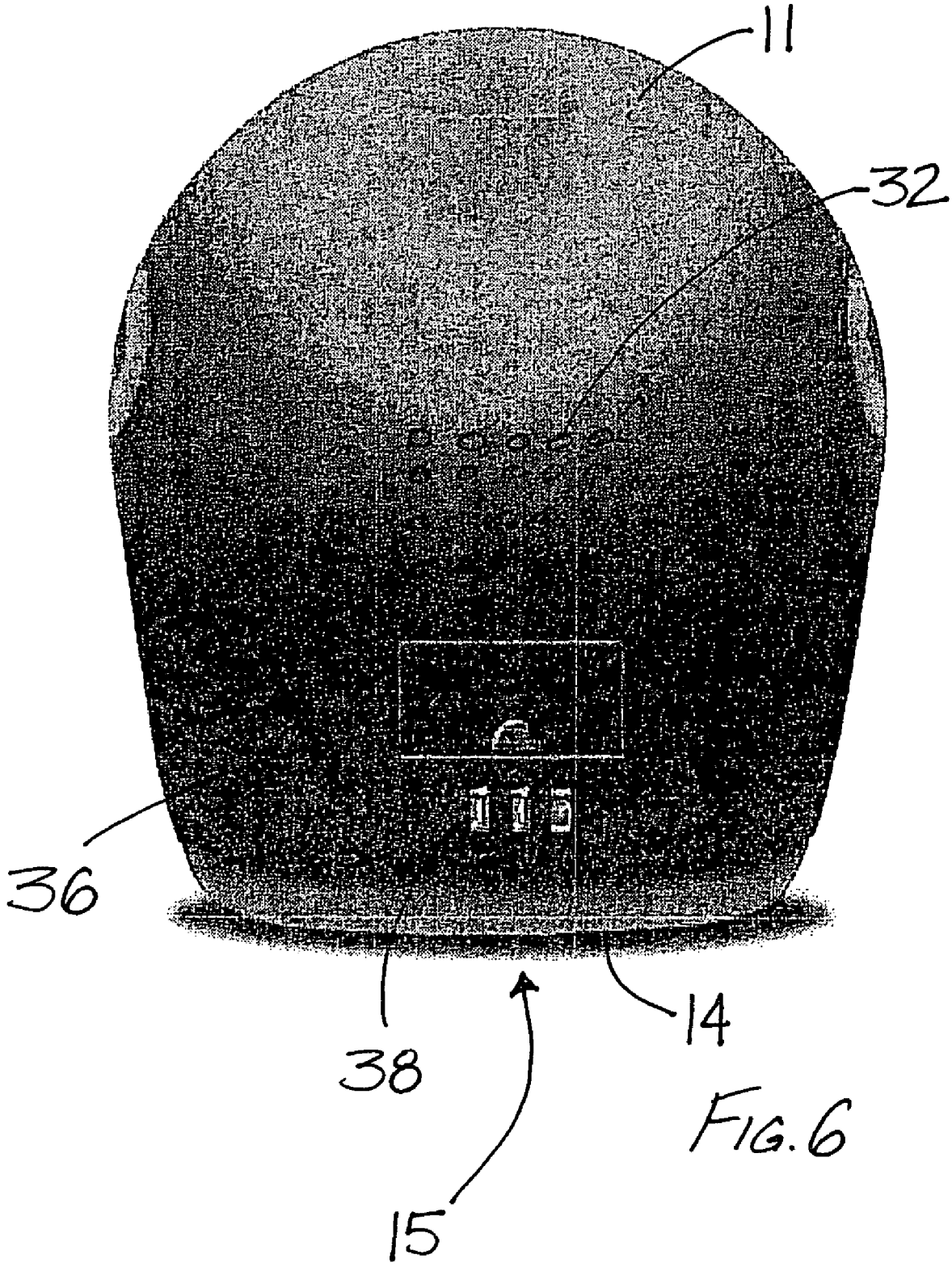
FIG. 6 is a rear view of the helmet of the present invention showing various optional features, including a speaker, a plurality of batteries, and communication jacks.
Figure 7:
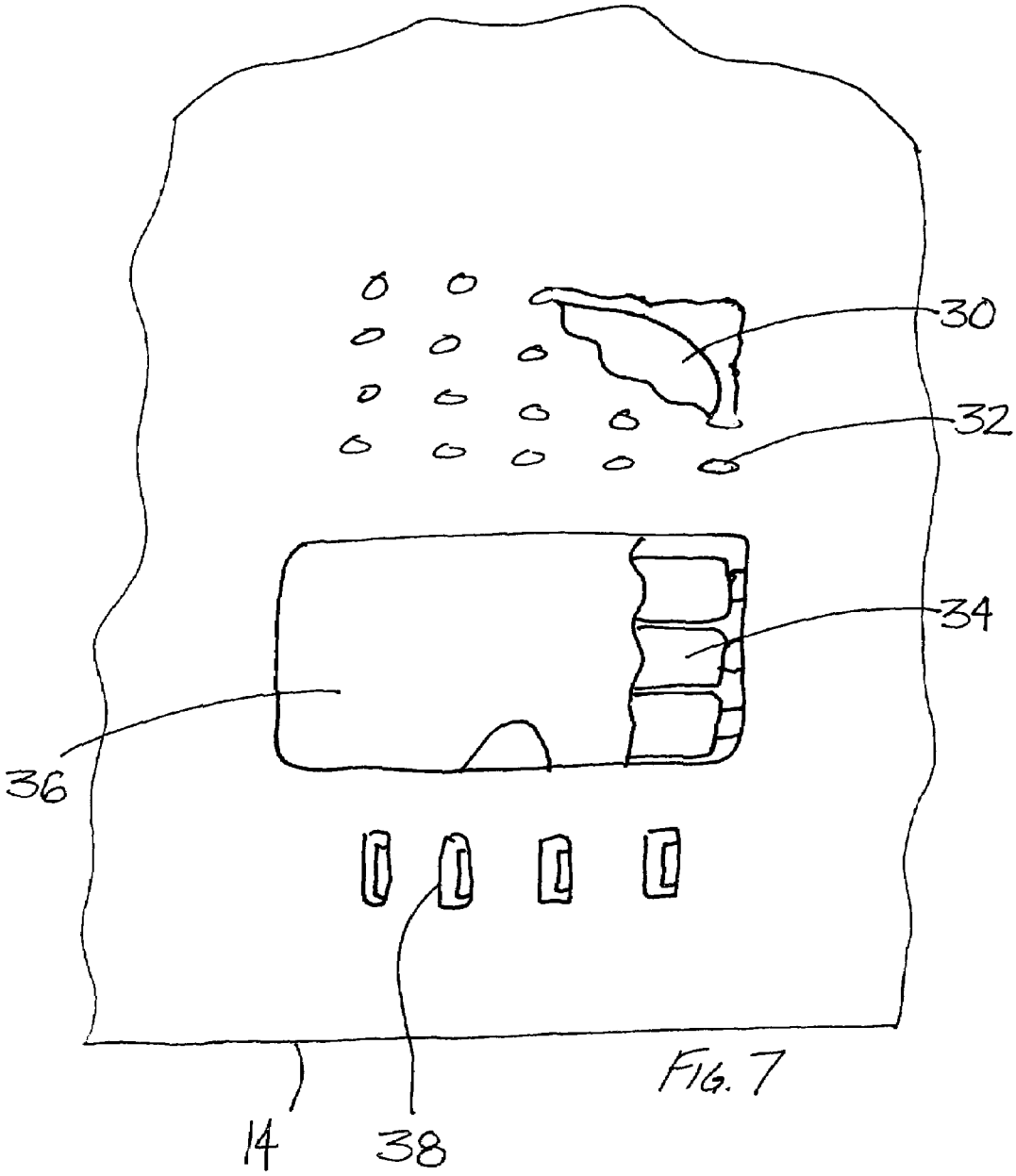
FIG. 7 is a rear view of a broken away portion of the helmet of the present invention, with a portion of the removable panel broken away to reveal the batteries behind the panel, and a portion of the perimeter wall of the helmet being broken away to reveal the speaker beneath the perimeter wall.
Figure 8:
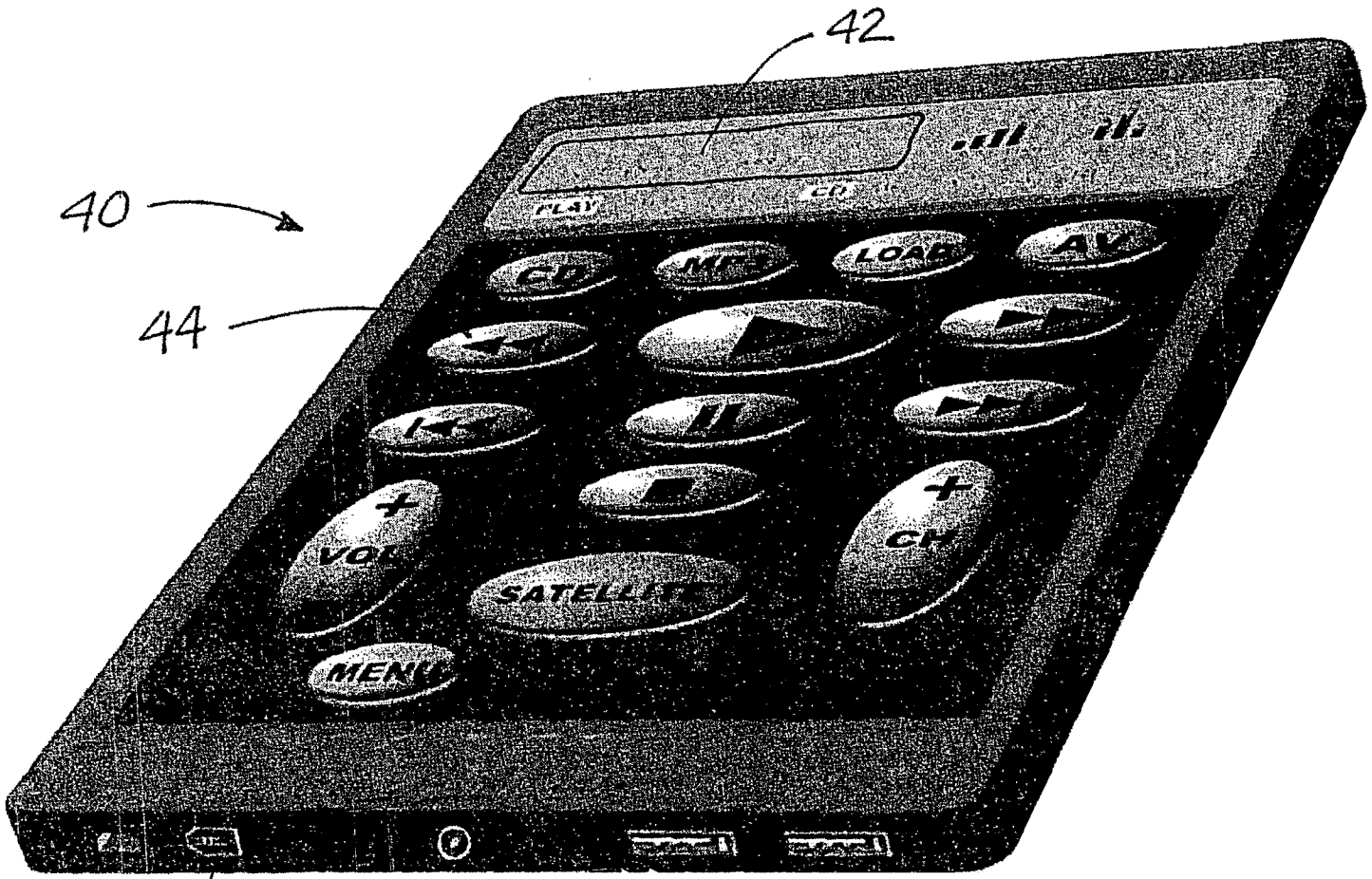
FIG. 8 is a perspective view of an optional wireless remote control for controlling the functions of the helmet.

As shown in FIGS. 6 through 8 7 of the drawings, the helmet system 10 may include additional, optional features. Turning to FIGS. 6 and 7, some embodiments of the helmet 11 of the invention may include a speaker 30 that projects sound externally from the exterior of the helmet through holes 32 in the shell of the helmet that permit the sound waves to escape the interior of the helmet. In one preferred embodiment, the speaker is positioned so as to direct sound rearwardly from the helmet so that a passenger on a motorcycle seated behind the primary rider is able to hear the sound being produced by the helmet system.

The helmet system 10 may also include an onboard power source for providing power to the various circuits of the components of the helmet system 10. The power source may comprise, for example, one or more batteries 34, which are either rechargeable or non-rechargeable, and permanently mounted or removable from the helmet, such as through a removable panel 36.

The helmet system 10 may also include one or more communication ports 38 that may be located on the shell of the helmet 11 and may be located, for example, on the rear of the helmet. The communication port 38 may be of virtually any type, including, but not limited to, USB ports and IEEE1394 (Firewire) ports. The ports 38 permit the transfer of data into the helmet to be stored in storage that is located on the helmet, such as a memory chip or a miniature disk drive, for example, or even to be recorded on a compact disc in the playing assembly. Thus, the communication ports 38 may be employed to transfer sound or music files to the helmet, including files in various formats, including, but not limited to, MP3, AIFF, AVI, as well as other digital music file formats.

The helmet system 10 may also include a remote control 40 (see FIG. 8) which may include a screen 42 which allows the user to scroll visually through the menu functions. The remote 40 may communicate wirelessly with the circuitry of the helmet. The remote control 40 may also be provided with a plurality of buttons 44 that are able to control the operation of the features of the helmet, such as, for example, the playback of the CD player, the playback of the digital file/MP3 player, the playing of a radio (terrestrial or satellite), as well as other functions that may be incorporated into the helmet system 10. Optionally, the remote 40 may be powered by a rechargeable battery, such as a 3.6V lithium ion battery.

The remote 40 may also include memory that stores a number of digital audio files, to permit a user to upload the digital music files to the remote for future downloads of the files to the helmet. The remote control 40 may also be provided with one or more communication ports 46 that allow the user to connect other devices to the remote 40, and permits relay of file data from an external device through the remote control 40 into the memory or storage of the helmet 11.

In use, the user depresses the lid button 29 and inserts a compact disc into the playing assembly 18 when the lid member 28 has reached the open position. The user then closes the lid member 28 and puts the helmet 11 on. The play button 22 can then be depressed to allow the user to listen to the music on the compact disc. The other buttons 21 can then be used to adjust playback of the compact disk.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A motorcycle helmet for playing an audio compact disc, the motorcycle helmet comprising:

a helmet configured to protect a head of a user from impact, said helmet having a perimeter wall defining an interior space, said perimeter wall having a lower peripheral lip defining a lower opening for accepting insertion of the head of the user into said interior space of said helmet, said perimeter wall having a forward peripheral lip defining a front opening for permitting the user to see when the head of the user is positioned in said interior space;

a playing assembly being positioned in said perimeter wall of said helmet, said playing assembly being configured to read audio information from a compact disc for playback;

a plurality of speakers each being positioned within said perimeter wall of said helmet, each of said speakers being operationally coupled to said playing assembly to audibly playback the audio information read by said playing assembly;

a plurality of buttons being operationally coupled to said playing assembly, said buttons being positioned in said perimeter wall of said helmet proximate said front opening of said helmet such that said buttons are adapted for being easily accessible by the user, each of said buttons being for controlling a function of said playing assembly when said buttons are actuated by the user; and a lid member positioned on said helmet substantially opposite of said lower opening such that said lid member is positioned toward a top of the helmet, said lid member being positioned in a top opening in said perimeter wall and being pivotally coupled to said perimeter wall of said helmet, said lid member being positioned adjacent said playing assembly, said lid member being pivotable between an open position providing access to said playing assembly and a closed position covering the compact disc for playback.

2. The motorcycle helmet as set forth in claim 1, further comprising a lid button for causing said lid member to be pivoted from said closed position to said open position when said lid button is actuated by the user, said lid button being positioned in said perimeter wall of said helmet proximate said front opening for being easily accessible by the user.

3. The motorcycle helmet as set forth in claim 1, further comprising a speaker for projecting sound externally from the interior space of the helmet to an exterior of the helmet.

4. The motorcycle helmet as set forth in claim 3, wherein the speaker is positioned so as to direct sound rearwardly from the helmet so that a passenger on a motorcycle seated behind a primary rider on the motorcycle is able to hear the sound being produced by the speaker.

5. The motorcycle helmet as set forth in claim 1, further comprising a plurality of holes in said perimeter wall of said helmet to permit sound from said speaker to move through said perimeter wall, said plurality of holes being positioned proximate to said speaker.

6. The motorcycle helmet as set forth in claim 1, further comprising an onboard power source.

7. The motorcycle helmet as set forth in claim 6, wherein said onboard power source comprises at least one removable battery.

8. The motorcycle helmet as set forth in claim 1, further comprising at least one data communication port in communication with said playback assembly.

9. The motorcycle helmet as set forth in claim 1, further comprising a remote control for controlling operation of the playing assembly.

10. The motorcycle helmet as set forth in claim 9, wherein the remote control communicates wirelessly with the playing assembly of the helmet.

11. The motorcycle helmet as set forth in claim 9, wherein the remote further includes memory configured to store digital files.

12. The motorcycle helmet as set forth in claim 1, wherein said buttons comprise a play button for actuating said playing assembly such that said playing assembly reads audio information from the compact disk received by said playing assembly.

13. The motorcycle helmet as set forth in claim 12, wherein said buttons comprise a stop button for actuating said playing assembly such that said playing assembly discontinues reading of audio information from the compact disc when the user has previously actuated said play button.

14. The motorcycle helmet as set forth in claim 13, wherein said buttons comprise a pause button for actuating said playing assembly such that said playing assembly pauses reading of audio information from the compact disc when said pause button is actuated once by the user, and for resuming reading of audio information from the compact disc when said pause button is actuated a second time by the user.

15. The motorcycle helmet as set forth in claim 14, wherein said buttons comprise a search button for actuating said playing assembly such that said playing assembly fast forwards through the audio information from the compact disc when the user has previously actuated said play button.

16. The motorcycle helmet as set forth in claim 15, wherein said buttons comprise a skip button for actuating said playing assembly such that said playing assembly skips to the audio information of the next song on the compact disc when the user has previously actuated said play button.

17. The motorcycle helmet as set forth in claim 16, wherein said buttons comprise a volume button for actuating said playing assembly for controlling the volume of said speakers.

* * * * *